US006278663B1

(12) United States Patent
Okeya et al.

(10) Patent No.: US 6,278,663 B1
(45) Date of Patent: Aug. 21, 2001

(54) ELECTRONIC APPARATUS AND CONTROL METHOD FOR ELECTRONIC APPARATUS

(75) Inventors: Makoto Okeya, Nagano-ken; Hiroshi Yabe, Shiojiri, both of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/459,951

(22) Filed: Dec. 13, 1999

(30) Foreign Application Priority Data

Dec. 14, 1998 (JP) ..... 10-355248
Oct. 7, 1999 (JP) ..... 11-287383

(51) Int. Cl.[7] ..... G04C 3/00
(52) U.S. Cl. ..... 368/204; 368/203; 368/66
(58) Field of Search ..... 368/203–205, 368/66

(56) References Cited

U.S. PATENT DOCUMENTS

Re. 35,043 * 9/1995 Takeda ..... 368/205
5,581,519 * 12/1996 Hara et al. ..... 368/205
6,061,304 * 5/2000 Nagata et al. ..... 368/205
6,069,846 * 5/2000 Nagata ..... 368/205

* cited by examiner

*Primary Examiner*—Bernard Roskoski

(57) ABSTRACT

A portable electronic apparatus and a control method for an electronic apparatus that detects the power-generating state of a power generating unit in a power-saving mode and to positively switch to a normal operation mode.

The power-generation voltage of a power generating unit is detected in a power-generation-voltage detection process (steps S2 and S12), and the operation mode of a unit to be driven is switched between a normal operation mode and a power-saving mode according to the power-generating state of the power generating unit or according to the manipulation state of manipulation means in an operation-mode control process (steps S3 to S7, and S10 to S15). In a limiter control process (step S8), the operation of a limiter is disabled when the operation mode of the unit to be driven is the power-saving mode. As a result, it is possible in the power-saving mode that the power-generating state of the power generating unit is detected and the operation mode is positively switched to the normal operation mode in the power-generation-voltage detection process. In a limiter-operation disablement release process (step S13), the limiter is again operated after the operation mode is switched to the normal operation mode.

17 Claims, 4 Drawing Sheets

ELECTRONIC APPARATUS AND CONTROL METHOD FOR ELECTRONIC APPARATUS

BACKGROUND OF THE INVENTION

1. Field of the Invention

The present invention relates to electronic apparatuses and control methods for electronic apparatuses, and more particularly, to the control technology of electronically controlled time-measurement apparatuses including a power generating mechanism.

2. Description of the Related Art

In recent years, compact electronic time-measurement apparatuses, such as wristwatches, have included a power generating unit such as a solar cell and operate without replacing a battery cell. These time-measurement apparatuses function by accumulating the power generated by the power generating unit in a large-capacity capacitor, and indicate time by discharging energy from the capacitor when power is not being generated by the power generating unit. Such time-measurement apparatuses enable non-interrupted operation without the need for a battery. It is expected that many electronic time-measurement apparatuses will include a power generating unit in the near future.

OBJECTS OF THE INVENTION

Therefore, it is an object of the present invention to provide an improved electronic time measurement apparatus.

Such an electronic time-measurement apparatus having a power generating unit is provided with a limiter circuit for limiting an applied voltage such that the power-generation voltage of the power generating unit does not exceed the dielectric strength of a power source unit having a power accumulating function, such as a large-capacity capacitor, and such that the power source voltage of the power source unit to be applied to a time-indication circuit does not exceed the dielectric strength of the time-indication circuit.

This limiter circuit electrically separates the power generating unit from the power source unit at the preceding stage of the power source unit, short-circuits the output of the power supply unit so as not to send the power-generation voltage to subsequent stages, and electrically separates the power source unit from the time-indication circuit at the subsequent stage of the power supply unit. By doing so, the limiter circuit prevents a power-generation voltage of the power generating unit that exceeds the dielectric strength of the power source unit, from being applied to the power source unit and prevents a power-source voltage exceeding the dielectric strength of the time-indication circuit from being applied to the time-indication circuit.

When the power generating unit is in a non-power-generating state for a predetermined period of time the operation mode is switched from a normal operation mode (indication mode) to a power-saving mode, where time is not indicated, in order to supply the power stably.

When the limiter circuit is in an operation state (limiter-on state), since the electrical information of the power generating unit is not sent at all to subsequent stages, the power generating state of the power generating unit cannot be detected after the operation mode is switched to the power-saving mode, and therefore, the operation mode cannot be returned to the normal operation mode.

Accordingly, it is an object of the present invention to provide an electronic apparatus and a control method for an electronic apparatus which allow the operation mode to be positively switched to a normal operation mode by detecting the power generating state of a power generating unit in a power-saving mode.

SUMMARY OF THE INVENTION

The present invention provides an improved electronic time measurement apparatus. In accordance with principles of the present invention, a portable electronic apparatus includes power generating means for generating power by converting a first energy to electrical energy, power source means for accumulating the electrical energy generated by the power generating means; means to be driven by electrical energy supplied from the power source means; power-generation detection means for detecting whether the power generating means is generating power; voltage detection means for detecting whether one of a power-generation voltage at the power generating means and an accumulated voltage at the power source means exceeds a predetermined reference voltage; limiter means for limiting the voltage of the electrical energy supplied to the power source means to a predetermined reference voltage, according to the detection result of the voltage detection means; operation-mode control means for switching the operation mode of the means to be driven between a normal operation mode and a power-saving mode, according to the detection result of the power-generation detection means; and limiter control means for disabling the limiter means when the means to be driven is switched to the power-saving mode.

The means to be driven in the present invention is time-indication means for indicating time wherein the operation-mode control means disables the time indication means when the means to be driven is switched to the power-saving mode; and restarts the time-indication means to indicate a current time when the power-saving mode is switched to the normal operation mode.

The time-indication means comprises an analog-time indicator and an indicator driving means for driving the analog time indicator, wherein the operation-mode control means comprises means for disabling the indicator driving means when the means to be driven is switched to the power-saving mode.

The limiter control means comprises means for re-activating the limiter means when the operation mode of the means to be driven is switched from the power-saving mode to the normal operation mode.

The operation-mode control means switches the operation mode according to the detection result of the voltage detection means.

A user manipulation means capable of various manipulations, wherein the operation-mode control means switches the operation mode according to the user manipulation of the user manipulation means.

The present invention further includes a control method for a portable electronic apparatus including a power generating unit for generating power by converting a first energy to an electrical energy, a power source unit for accumulating the electrical energy obtained by the power generating unit, a unit to be driven by the electrical energy, and a limiter unit for limiting the voltage of the electrical energy, supplied from the power generating unit to the power source unit, to a predetermined reference voltage, the control method comprising: a power-generation detection step for detecting whether the power generating unit is generating power, a voltage detection step for detecting whether one of a power-generation voltage at the power generating unit and an accumulated voltage at the power source unit exceeds the predetermined reference voltage, an operation-mode control step for switching an operation mode of the unit to be driven between a normal operation mode and a power-saving mode, according to whether the power generating unit is generating power, and a limiter control step for disabling the limiter unit when the operation mode of the unit to be driven is switched to the power-saving mode.

The unit to be driven is a time-indication unit including an analog time indicator and an indicator driving unit for driving the analog time indicator, wherein the operation-mode control step comprises disabling the indicator driving unit when the unit to be driven is switched to the power-saving mode.

The limiter control step further comprises re-activating the limiter unit when the operation mode of the unit to be driven is switched from the power-saving mode to the normal operation mode.

The present invention further comprising an electronic apparatus, which is portable, comprising, a power generator for generating power by converting a first energy to an electrical energy, a power source for accumulating the electrical energy generated by the power generator, means to be driven by electrical energy supplied from the power source, a power-generation detector for detecting whether the power generator is generating power, a voltage detector for detecting whether one of a power-generation voltage at the power generator and an accumulated voltage at the power source exceeds a predetermined reference voltage, a voltage limiter for limiting the voltage of the electrical energy supplied to the power source to a predetermined reference voltage, according to a detection result of the voltage detector, an operation-mode controller for switching the operation mode of the means to be driven between a normal operation mode and a power-saving operation mode, according to a detection result of the power-generation detector, and a voltage limiter controller for disabling the voltage limiter when means to be driven is switched to the power-saving mode. The means to be driven is a time-indicator for indicating time wherein the operation-mode controller disables the time indicator when the means to be driven is switched to the power-saving mode; and restarts the time-indicator to indicate a current time when the power-saving mode is switched to the normal operation mode.

The time-indicator comprises an analog-time indicator and an indicator driver for driving the analog time indicator and wherein the operation-mode controller comprises a circuit for disabling the indicator driver when the means to be driven is switched to the power-saving mode.

The voltage limiter controller comprises a circuit for re-activating the voltage limiter when the operation mode of the means to be driven is switched from the power-saving mode to the normal operation mode.

The operation-mode controller switches the operation mode according to the detection result of the voltage detector.

The electronic apparatus according to the present invention further comprises a user input unit capable of various manipulations, and wherein the operation-mode controller switches the operation mode according to the user manipulation of the user input unit.

Other objects and advantages together with a clearer understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

Figure 1:
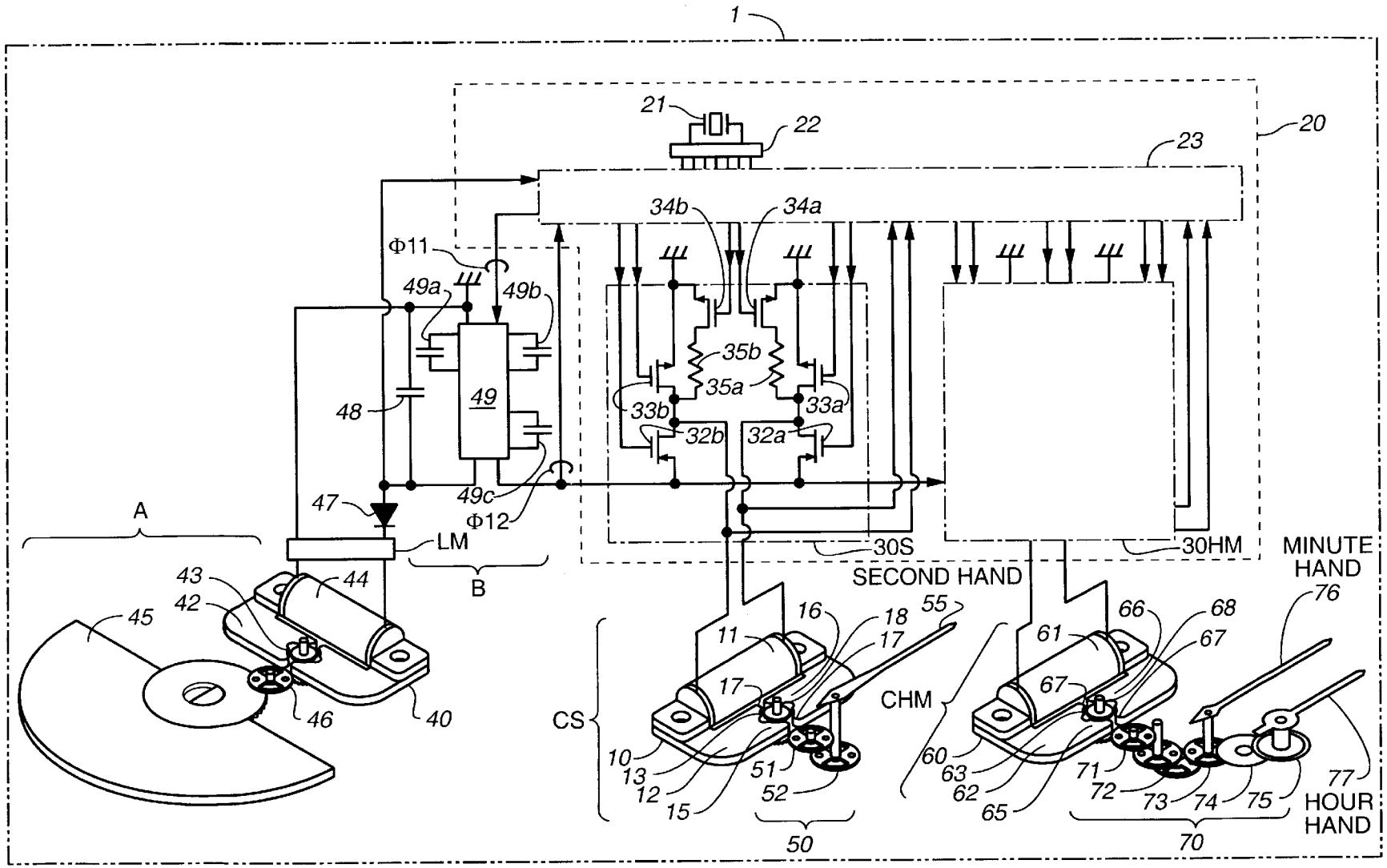
FIG. 1 is a schematic diagram of a time-measurement apparatus according to an embodiment of the present invention.

A preferred embodiment of the present invention will be described below by referring to the drawings.

[1] Outlined Structure

FIG. 1 shows a schematic diagram of an outlined structure of a time-measurement apparatus 1 according to an embodiment of the present invention.

The time-measurement apparatus 1 represents a wristwatch that is typically worn on a user's wrist.

The time-measurement apparatus 1 according to the present embodiment includes a power generating section A for generating alternating electrical power and a power source section B for rectifying the alternating voltage sent from the power generating section A, accumulating a boosted voltage, and supplying electrical power to each component section. A control section 23 includes a power-generating-state detection section 91 (see FIG. 2) and detects the power-generating state of the power generating section A, for controlling the entire apparatus according to the detection result. The time-measurement apparatus 1 also includes, a second-hand moving mechanism CS for driving a second hand 55 with the use of a stepper motor 10, an hour-hand-and-minute-hand moving mechanism CHM for driving a minute hand and an hour hand with the use of a stepper motor, a second-hand driving section 30S for driving the second-hand moving mechanism CS according to a control signal sent from the control section 23, and an hour-hand-and-minute-hand driving section 30HM for driving the hour-hand-and-minute-hand moving mechanism CHM according to a control signal sent from the control section 23. An external input unit 100 (see FIG. 2) performs a specifying operation such that the operation mode of the time-measurement apparatus 1 is switched from a time-indication mode to a calendar correction mode, a time correction mode, or a power-saving mode, described later.

The control section 23 switches, according to the power-generating state of the power generating section A, between an indication mode (normal operation mode) in which the moving mechanisms CS and CHM are driven indicates time and the power-saving mode in which power is not provided to the second-hand moving mechanism CS and the hour-hand-and-minute-hand moving mechanism CHM. When sufficient power is generated by the user's movement of the time-measurement apparatus, such that a predetermined power-generation voltage is detected, the power-saving mode is forcibly switched to the indication mode.

[2] Detailed Structure

Each component section of the time-measurement apparatus 1 will be described below. The control section 23 will be described later by the use of functional blocks.

[2.1] Power Generating Section

The power generating section A is formed of a power generating unit 40, an oscillating weight 45, and a speed-increasing gear 46.

Preferably the power generating unit 40 employs an electromagnetic-induction-type alternating power generating unit, in which a power generating rotor 43 rotates inside a power generating stator 42 and electrical power induced in a power generating coil 44 connected to the power generating stator 42 can be output externally.

The oscillating weight 45 functions to transfer kinetic energy to the power generating rotor 43. The movement of this oscillating weight 45 is transferred to the power generating rotor 43 through the speed-increasing gear 46.

The oscillating weight 45 oscillates in response to user arm motion. Therefore, time-measurement apparatus 1 is driven by the electrical power, which is generated by the user's everyday motion.

[2.2] Power Source Section

The power source section B is formed of a limiter circuit LM for preventing an excessive voltage from being applied to a subsequent circuit, a diode 47 serving as a rectifying circuit, a large-capacity capacitor 48, and a buck-boost converting circuit 49. As shown in FIG. 1, the limiter circuit LM, the rectifying circuit (diode 47), and the large-capacity capacitor 48 are disposed in that order from the power generating section A. They can be disposed in the order of the rectifying circuit (diode 47), the limiter circuit LM, and the large-capacity capacitor 48.

The buck-boost converting circuit 49 increases or reduces a voltage in multiple steps with the use of a plurality of capacitors 49*a*, 49*b*, and 49*c*. According to a control signal φ11 sent from the control section 23, a voltage sent to the second-hand driving section 30S and the hour-hand-and-minute-hand driving section 30HM can be adjusted.

The power source section B uses Vdd (a higher voltage) as a reference voltage (GND), and Vss (a lower voltage) as a power voltage.

An example of the limiter circuit LM will be described below by referring to FIG. 3.

Figure 2:
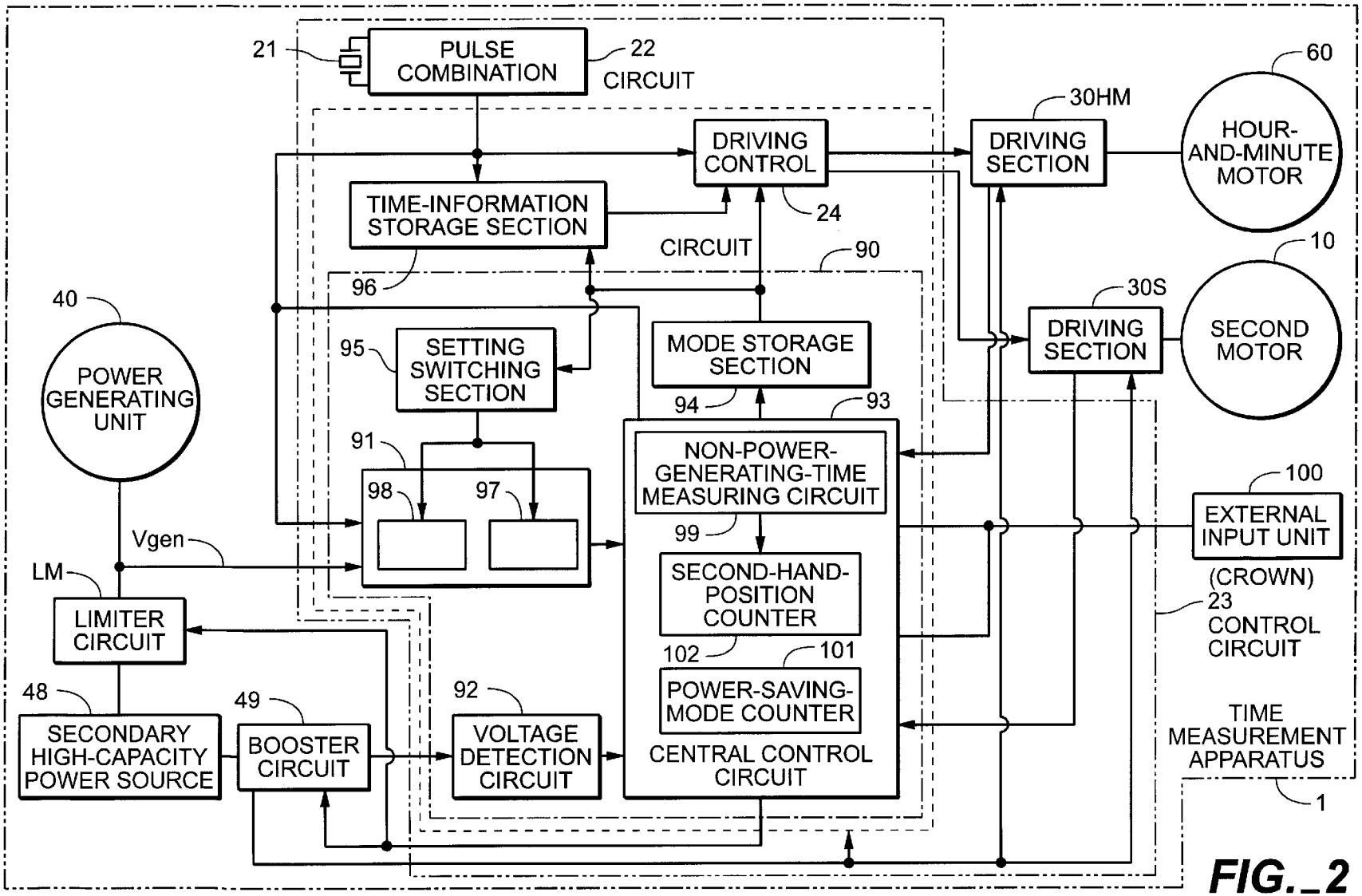
FIG. 2 is a functional block diagram of a control section and its peripheral structure according to the embodiment.
Figure 3:
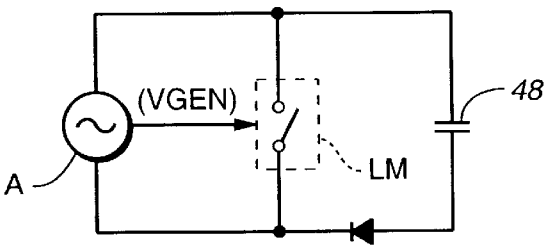
FIG. 3 is a view showing the principle of a limiter circuit.

The limiter circuit LM functions in an equivalent manner to a switch for short-circuiting the power generating section A, as shown in FIG. 3. When the power-generation voltage VGEN of the power generating section A exceeds a predetermined limit reference voltage VLM, the limiter circuit is turned on (closed). The switch portion of the limiter circuit LM is formed of a transistor, and it is controlled ON and OFF by a control signal output from a central control circuit 93 shown in FIG. 2.

As a result, the power generating section A is electrically separated from the large-capacity capacitor 48. In the present embodiment, the power generating section A is short-circuited to control the limiter. The path of the power generating section A may be opened to control the limiter.

With this operation, an excessive power-generation voltage VGEN is not applied to the large-capacity capacitor 48. A power-generation voltage VGEN exceeding the dielectric strength of the large-capacity capacitor is prevented from being applied, and thereby damage of the large-capacity capacitor 48 is avoided and further damage of the time-measurement apparatus 1 is avoided.

A diode shown in FIG. 3 serves as a reverse-current-prevention diode, and prevents the large-capacity capacitor 48 from being short-circuited when the limiter circuit LM is on.

The limiter circuit LM may be configured such that the connection of the power generating section A and the large-capacity capacitor 48 is opened by a switch.

[2.3] Hand Moving Mechanisms

[2.3.1] Second-hand Moving Mechanism

The stepper motor 10 used in the second-hand moving mechanism CS is also called a step-servo motor, which is used as an actuator in digital control apparatuses in many cases, and is driven by a pulse signal. Many compact and lightweight stepper motors have been employed as actuators in portable, compact electronic apparatuses and information apparatuses in recent years. Time-measurement apparatuses, such as electronic time-measurement units, time switches, and chronographs, are representative of such electronic apparatuses.

The stepper motor 10 according to the present embodiment is provided with a driving coil 11 for generating magnetic power by a driving pulse sent from the second-hand driving section 30S, a stator 12 excited by this driving coil 11, and a rotor 13 which rotates inside the stator 12 by an excited magnetic field.

The stepper motor 10 is of a PM type (permanent-magnet rotation type), in which the rotor 13 is formed of a disc-shaped two-pole permanent magnet.

The stator 12 is provided with a magnetic saturation section 17 such that different magnetic poles are generated at phases (poles) 15 and 16 around the rotor 13 by the magnetic power generated by the driving coil 11.

To specify the rotation direction of the rotor 13, an inner notch 18 is provided at an appropriate position in the inner periphery of the stator 12. Cogging torque is generated to stop the rotor 13 at an appropriate position.

The rotation of the rotor 13 in the stepper motor 10 is transferred to the second hand 55 through a wheel train 50 formed of an intermediate second wheel 51 and a second wheel (second-indicator wheel) 52 engaged with the rotor 13 through a pinion. Seconds are indicated by the rotation of rotor 13 and second hand 55.

[2.3.2] Hour-hand-and-minute-hand Moving Mechanism

A stepper motor 60 used in the hour-hand-and-minute-hand moving mechanism CHM has the same structure as the stepper motor 10.

The stepper motor 60 according to the present embodiment is provided with a driving coil 61 for generating magnetic power by a driving pulse sent from the hour-hand-and-minute-hand driving section 30HM, a stator 62 excited by this driving coil 61, and a rotor 63 which rotates inside the stator 62 by an excited magnetic field.

The stepper motor 60 is of the PM type (permanent-magnet rotation type), in which the rotor 63 is formed of a disc-shaped two-pole permanent magnet. The stator 62 is provided with a magnetic saturation section 67 such that different magnetic poles are generated at phases (poles) 65 and 66 around the rotor 63 by the magnetic power generated by the driving coil 61. To specify the rotation direction of the rotor 63, an inner notch 68 is provided at an appropriate position in the inner periphery of the stator 62. Cogging torque is generated to stop the rotor 63 at an appropriate position.

The rotation of the rotor 63 in the stepper motor 60 is transferred to each hand through a wheel train 70 formed of a second wheel 71, a third wheel 72, a center wheel (minute-indicator wheel) 73, a minute wheel 74, and a hour wheel (hour-indicator wheel) 75 engaged with the rotor 63 through a pinion. The center wheel 73 is connected to the minute hand 76, and the hour wheel 75 is connected to the hour hand 77. With these hands, the hour and the minute are indicated by the rotation of the rotor 63.

Although not shown in the figure, a transfer system (to indicate the day, for example, an intermediate hour wheel, an intermediate data wheel, a date indicator driving wheel, and a date indicator) for indicating the year, month, and day (calendar) can be, of course, connected to the wheel train 70. In this case, a calendar-corrector wheel train (such as a first calendar corrector transfer wheel, a second calendar corrector transfer wheel, a calendar corrector wheel, and a date indicator) can further be provided.

[2.4] Second-hand Driving Section and Hour-hand-and-minute-hand Driving Section

The second-hand driving section 30S and the hour-hand-and-minute-hand driving section 30HM will be described next. In this case, since the second-hand driving section 30S and the hour-hand-and-minute-hand driving section 30HM have the same structure, only the second-hand driving section 30S will be described.

The second-hand driving section 30S sends various driving pulses to the stepper motor 10 under the control of the control section 23.

The second-hand driving section 30S is provided with a bridge circuit formed of a p-channel MOS 33*a* and an n-channel MOS 32*a* connected in series and a p-channel MOS 33*b* and an n-channel MOS 32*b*.

The second-hand driving section 30S is also provided with rotation detecting resistors 35*a* and 35*b* connected in parallel to the p-channel MOSs 33*a* and 33*b*, and p-channel sampling MOSs 34*a* and 34*b* for sending chopper pulses to the resistors 35*a* and 35*b*. Therefore, when control pulses having different polarities and different pulse widths are applied from the control section 23 to the gate electrodes of the MOSs 32*a*, 32*b*, 33*a*, 33*b*, 34*a*, and 34*b* at various timings, driving pulses having different polarities are sent to the driving coil 11 or a detection pulse for exciting an induction voltage used for detecting the rotation of the rotor 13 and for detecting a magnetic field is sent.

[2.5] Control Section

The structure of the control section 23 will be described next by referring to FIG. 2.

FIG. 2 shows the control section 23 and the functional blocks of its peripheral structure.

The control section 23 is schematically formed of a pulse combination circuit 22, a mode setting section 90, a time-information storage section 96, and a driving control circuit 24.

The pulse combination circuit 22 is provided with an oscillating circuit for oscillating a reference pulse having a stable frequency with the use of a reference oscillation source 21 such as a crystal resonator, and a combination circuit for combining the reference pulse and scaled pulses obtained by scaling the reference pulse to generate pulse signals having different pulse widths and different timings.

The mode setting section 90 is formed of the power-generating-state detection section 91, a setting-switching section 95 for switching a setting used for detecting a power-generating state, a voltage detection circuit 92 for detecting a charged voltage Vc of the large-capacity capacitor 48, the central control circuit 93 for controlling the time-indication mode according to the power-generating state and for controlling a boost magnification according to the charged voltage, and a mode storage section 94 for storing the mode.

The power-generating-state detection section 91 is provided with a first detection circuit 97 for comparing the generated voltage Vgen of the power generating unit 40 with a specified voltage Vo to determine whether power generation is detected. A second detection circuit 98 compares a specified time period To with a power-generation lasting time Tgen, which represents the time that the generated voltage Vgen obtained is equal to or greater than a specified voltage Vbas. Vbas is set lower than the specified voltage Vo. When either condition is satisfied in the first and second detection circuits 97 and 98, the power-generating-state detection section 91 determines that a power-generating state is detected. The specified voltages Vo and Vbas are negative voltages against Vdd (=GND), and indicate potential differences from Vdd.

The specified voltage Vo and the specified time period To can be switchably controlled by the setting-switching section 95. The setting-switching section 95 changes the settings Vo and To of the first and second detection circuits 97 and 98 in the power-generation detection circuit 91 when the indication mode is switched to the power-saving mode. In the present embodiment, settings Va and Ta for the indication mode are set lower than settings Vb and Tb for the power-saving mode. Therefore, to switch from the power-saving mode to the indication mode, sufficient power must be generated to be detected by detection circuits 97 and 98. Preferably, Vb and Tb are set such that generating sufficient power to switch from the power saving mode to the indication mode requires the time-measurement apparatus to be worn on the user's arm. In other words, the settings Vb and Tb are set for the power-saving mode such that active charging caused by user arm movement can be detected.

The central control circuit 93 is provided with a non-power-generating-time measuring circuit 99 for measuring a non-power-generating time Tn, during which, power generation is not detected in the first and second detection circuits 97 and 98. When the non-power-generating time Tn exceeds for a predetermined specified time period, the indication mode is switched to the power-saving mode.

On the other hand, when the power-generating-state detection section 91 determines that the power generating section A is in the power-generating state and the charged voltage VC of the large-capacity capacitor 48 is sufficient, the power-saving mode is switched to the indication mode.

During the power-saving mode, the limiter circuit LM is turned on (closed) and the power generating section A is in a short-circuit state. Since the power-generating-state detection section 91 cannot detect power generation even if the power generating section A is in the power-generating state, the power-saving mode cannot be switched to the indication mode.

Therefore, in the present embodiment, when the operation mode is the power-saving mode, the limiter circuit LM is set to the off (open) state irrespective of the power-generating state of the power generating section A so that the power-generating-state detection section 91 can positively detect the power-generating state of the power generating section A.

Since the power source section B is provided with the buck-boost converting circuit 49 in the present embodiment, if the charged voltage VC is some degree lower, the power source voltage is increased with the use of the buck-boost converting circuit 49 to allow the hand moving mechanisms CS and CHM to be driven.

Conversely, if the charged voltage VC is some degree higher and is higher than the driving voltages of the hand moving mechanisms CS and CHM, the power source voltage is reduced with the use of the buck-boost converting circuit 49 to allow the hand moving mechanisms CS and CHM to be driven.

The central control circuit 93 determines the voltage magnification according to the charged voltage VC and controls the buck-boost converting circuit 49.

If the charged voltage VC is too low, however, a power source voltage required for operating the hand moving mechanisms CS and CHM cannot be obtained even if the charged voltage is increased. In such a case, when the power-saving mode is switched to the indication mode, correct time indication cannot be performed and in addition, power is wasted.

Therefore, in the present embodiment, the charged voltage VC is compared with the predetermined specified voltage Vo to determine whether the charged voltage VC is sufficient. This determination is a condition for switching the power-saving mode to the indication mode.

The central control circuit 93 is provided with a power-saving-mode counter 101 for determining whether a predetermined specifying operation of forced switching to the power-saving mode is performed within a predetermined time period when the user manipulates the external input unit 100. Central control circuit 93 also includes a second-hand-position counter 102 that counts cyclically such that a count of zero corresponds to a predetermined power-saving-mode indication position (for example, the position of one o'clock).

The operating mode is stored in the mode storage section 94, and the information is sent to the driving control circuit 24, the time-information storage section 96, and the setting-switching section 95. When the indication mode is switched to the power-saving mode, the driving control circuit 24 stops sending pulse signals to the second-hand driving section 30S and the hour-hand-and-minute-hand driving section 30HM to stop the operations of the second-hand driving section 30S and the hour-hand-and-minute-hand driving section 30HM. Accordingly, the motor 10 and 60 stop rotating and time indication is halted.

The time-information storage section 96 is, more precisely, formed of an up/down counter (not shown). When the indication mode is switched to the power-saving mode, the time-information storage section 96 receives a reference signal generated by the pulse combination circuit 22, starts time measurement, and indexes the count to measure a power-saving-mode lasting time.

When the power-saving mode is switched to the indication mode, the count of the up/down counter is indexed down. While the count is indexing down, the driving control circuit 24 sends fast-feed pulses to the second-hand driving section 30S and the hour-hand-and-minute-hand driving section 30HM. When the count of the up/down counter reaches zero, that is, i.e., when the fast-feed hand moving time corresponding to the power-saving-mode lasting time, which also corresponds to the fast-feed-hand-moving elapsed time, elapses, a control signal for terminating the fast-feed pulses is generated and sent to the second-hand driving section 30S and the hour-hand-and-minute-hand driving section 30HM.

As a result, time indication again shows the current time.

As described above, the time-information storage section 96 also includes the function for recovering the current time on a re-indicated time indicator.

The driving control circuit 24 generates driving pulses according to various pulses output from the pulse combination circuit 22. In the power-saving mode, driving pulses are not sent. Immediately after the power-saving mode is switched to the indication mode, the fast-feed pulses, having a short pulse interval, are sent to the second-hand driving section 30S and the hour-hand-and-minute-hand driving section 30HM as driving pulses, in order to recover the current time on the re-indicated time indicator.

After sending the fast-feed pulses, driving pulses having a normal pulse interval are sent to the second-hand driving section 30S and the hour-hand-and-minute-hand driving section 30HM.

[3] Operation in the Present Embodiment

Figure 4:
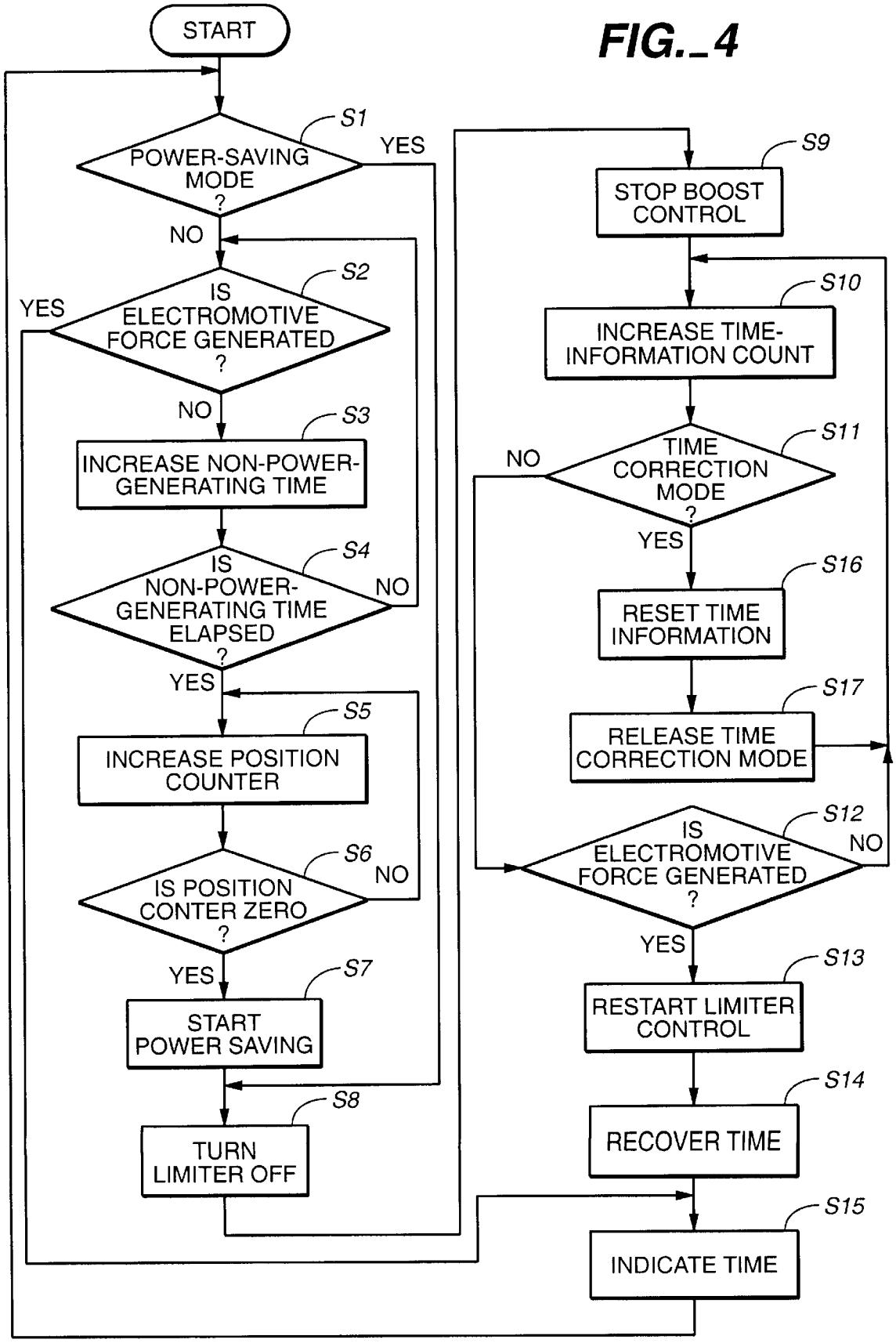
FIG. 4 is an operational flowchart in the embodiment.

FIG. 4 is a flowchart of the operation of the time-measurement apparatus according to the present invention.

The control circuit 23 determines whether the operation mode is the power-saving mode or not (in step S1).

If the operation mode is the power-saving mode, the processing proceeds to step S8, described later.

If the operation mode is not the power-saving mode, that is, that the operation mode is the indication mode, the central control circuit 93 determines, according to the detection signal of the power-generating-state detection unit 91, whether there is an electromotive force, that is, whether the power generating unit 40 is generating power.

If an electromotive force is detected the processing proceeds to step S15, time indication continues, and the processing returns to the step S1 again.

If electromotive force is not detected in step S2, that is, that power generation is not performed the non-power-generating-time measuring circuit 99 increases the count of the non-power-generating time Tn (in step S3).

The central control circuit 93 then determines whether the non-power-generating time Tn lasts longer than the predetermined specified time period (in step S4).

If the non-power-generating time Tn does not exceed the predetermined specified time period the processing proceeds to step S2 again and the processes from step S2 to step S4 are repeated.

If the non-power-generating time Tn exceeds the predetermined specified time period the count of the second-hand-position counter 102, which counts cyclically, is increased (in step S5). Step S6 determines whether the count of the second-hand-position counter 102 is zero, that is, whether the second hand reaches the predetermined power-saving-mode indication position (for example, the position of one o'clock).

If the count of the second-hand-position counter 102 is not zero, that is, that the second hand has not reached the predetermined power-saving-mode indication position the processing proceeds to step S5 again, and the count of the second-hand-position counter 102 is increased.

If the count of the second-hand-position counter 102 is zero, that is, that the second hand reaches the predetermined power-saving-mode indication position, the second hand is stopped at the current position, time indication is halted, and the operation mode is switched to the power-saving mode (in step S7). Accordingly, the second hand stops at the power-saving-mode indication position, indicating that the time-measurement apparatus 1 is in the power-saving mode.

When a power-saving-mode control signal sent from the mode storage section 94 is set to an "H" level, the limiter circuit LM is turned off in step S8 enabling the power-generating-state detection section 91 to positively detect the power-generating state of the power generating section A.

Then, the central control circuit 93 controls the buck-boost converting circuit 49 so as to stop boost control (in step S9).

The reason why the boost control is stopped in the power-saving mode will be described here.

In general, to maintain the operation voltage of the time-measurement apparatus within an appropriate range for a long period with limited energy, the power source unit needs to control the buck-boost converting circuit 49 for the boost control. In the indication mode, if the power source voltage is reduced and the driving voltage for moving the hands becomes less than a predetermined driving voltage, the boost control is performed to increase the driving voltage to continue moving the hands.

On the other hand, in the power-saving mode, the boost control is preferably disabled. This enabled the present invention to perform time recovery processing (in step S14), a voltage level less than a time-recovery-possible voltage to suppress energy consumption as much as possible. This also enables charging until the voltage level reaches a voltage at which the time-recovery processing can promptly be performed when the power-saving mode is switched to the indication mode.

The time-information storage section 96 increases the time-information count corresponding to the elapsed time in the power-saving mode in order to perform the time-recovery processing (in step S14), and then determines (in step S11) whether the user has manipulated the external input unit (the crown and a position detection unit) to switch the operation mode of the time-measurement apparatus 1 to the time correction mode.

If the user has not manipulated the external input unit 100, step S12 determines whether the power generating unit 40 is generating electrical power with an electromotive force equal to or greater than the predetermined electromotive force which indicates whether the operation mode is switched to the indication mode.

If the power generating unit 40 is not generating electrical power with an electromotive force equal to or greater than the predetermined electromotive force the processing proceeds to the step S10 again and the time-information count corresponding to the elapsed time in the power-saving mode is increased and the operation mode remains in the power-saving mode.

If the power generating unit 40 is generating electrical power with an electromotive force equal to or greater than the predetermined electromotive force the control of the limiter circuit LM is restarted (in step S13), the operation mode is switched from the power-saving mode to the indication mode, and the time-recovery processing is performed (in step S14). The current time is then recovered according to the count of the time-information storage section 96.

Time indication then continues (in step S15), as the processing proceeds to step S1 again, and the same processing is repeated.

If the user manipulated the external input unit 100 to switch to the time correction mode, the count of the time-information storage section 96 is reset (in step S16).

When the user manipulates the external input unit 100 to release the time correction mode, the processing proceeds to step S10 again. The time-information count corresponding to the elapsed time in the power-saving mode is increased for the time-recovery processing (in step S14), and the same processes are repeated until the power-saving mode is released.

[4] Advantage of the Present Embodiment

As described above, according to the time-measurement apparatus 1 of the present embodiment, when the operation mode is switched to the power-saving mode, the limiter circuit LM is turned off (opened) to enable the power-generating-state detection section 91 to positively detect the power-generating state of the power generating section A. This prevents a case in which the power-generating state cannot be detected because the power generating unit is set to a short-circuited condition in the power-saving mode, and assures that the power-saving mode can be positively switched to the normal operation mode.

[5] Modified Embodiments

[5.1] First Modification

In the above embodiment, the time-measurement apparatus in which the stepper motor 10 and the stepper motor 60 are used to drive the analog indicators for time indication has been described. The present invention can also be applied to a digital time-measurement apparatus which performs time indication by the use of an LCD.

[5.2] Second Modification

In the above embodiment, the two stepper motors 10 and 60 are simultaneously stopped when the operation mode is switched to the power-saving mode. It is also possible that a plurality of power-saving-mode stages are specified, only the stepper motor 10, corresponding to the second hand, is stopped in a first stage of power-saving mode, and the stepper motor 60, corresponding to the hour and minute hands, is further stopped in a second stage of power-saving mode.

[5.3] Third Modification

In the above embodiment, the time-measurement apparatus in which the two motors are used to indicate the hour and the minute and the second is taken as an example. The present invention can also be applied to a time-measurement apparatus in which one motor is used to indicate the hour, the minute, and the second.

The present invention can further be applied to a time-measurement apparatus having three or more motors (motors separately controlling the second hand, the minute hand, the hour hand, the calendar, and the chronograph).

[5.4] Fourth Modification

In the above embodiment, the electromagnetic power-generation unit is employed as the power generating unit 40, in which the rotational movement of the oscillating weight 45 is transferred to the rotor 43 and the rotation of the rotor 43 causes the electromotive force Vgen at the output coil 44. The present invention is not limited to this case. For example, a power generating unit which generates an electromotive force by rotational movement caused by the restitutive force (corresponding to the first energy) of a spring, or a power generating unit which generates electrical power by a piezoelectric effect by applying external- or self-vibration or displacement (corresponding to the first energy) to a piezoelectric member may be used.

A power generating unit which generates electrical power by photoelectric conversion by the use of optical energy (corresponding to the first energy) such as sunlight may further be used.

Furthermore, a power generating unit which generates electrical power by thermal power generation by the use of a temperature difference (thermal energy, corresponding to the first energy) between one portion and another portion may be used.

An electromagnetic-induction-type power generating unit which receives stray electromagnetic waves, such as broadcasting waves and communication waves, and uses their energy (corresponding to the first energy) can also be used.

[5.5] Fifth Modification

In the above embodiment, the wristwatch-type time-measurement apparatus 1 has been described as an example. The present invention is not limited to this case. In addition to wristwatches, the present invention can be applied to pocket watches. The present invention can also be applied to electronic apparatuses such as pocket calculators, portable phones, portable personal computers, electronic pocketbooks, portable radios, and portable VTRs.

[5.6] Sixth Modification

In the above embodiment, the reference potential (GND) is set to Vdd (a higher potential). The reference potential (GND) may, of course, be set to Vss (a lower potential). In this case, the specified voltages Vo and Vbas indicate potential differences from the detection level set to the higher potential with Vss being set to the reference.

[5.7] Seventh Modification

In the above embodiment, the indication mode is automatically switched to the power-saving mode. It is also possible that the operation of the limiter circuit is disabled even when the operation mode is forcibly switched to the power-saving mode by detecting a user's manipulation on the external input apparatus, for example, a special manipulation on the crown, and the operation of the limiter circuit is enabled again when the operation mode is forcibly switched to the normal operation mode.

[6] Detailed Example Structure in the Above Embodiment

Figure 5:
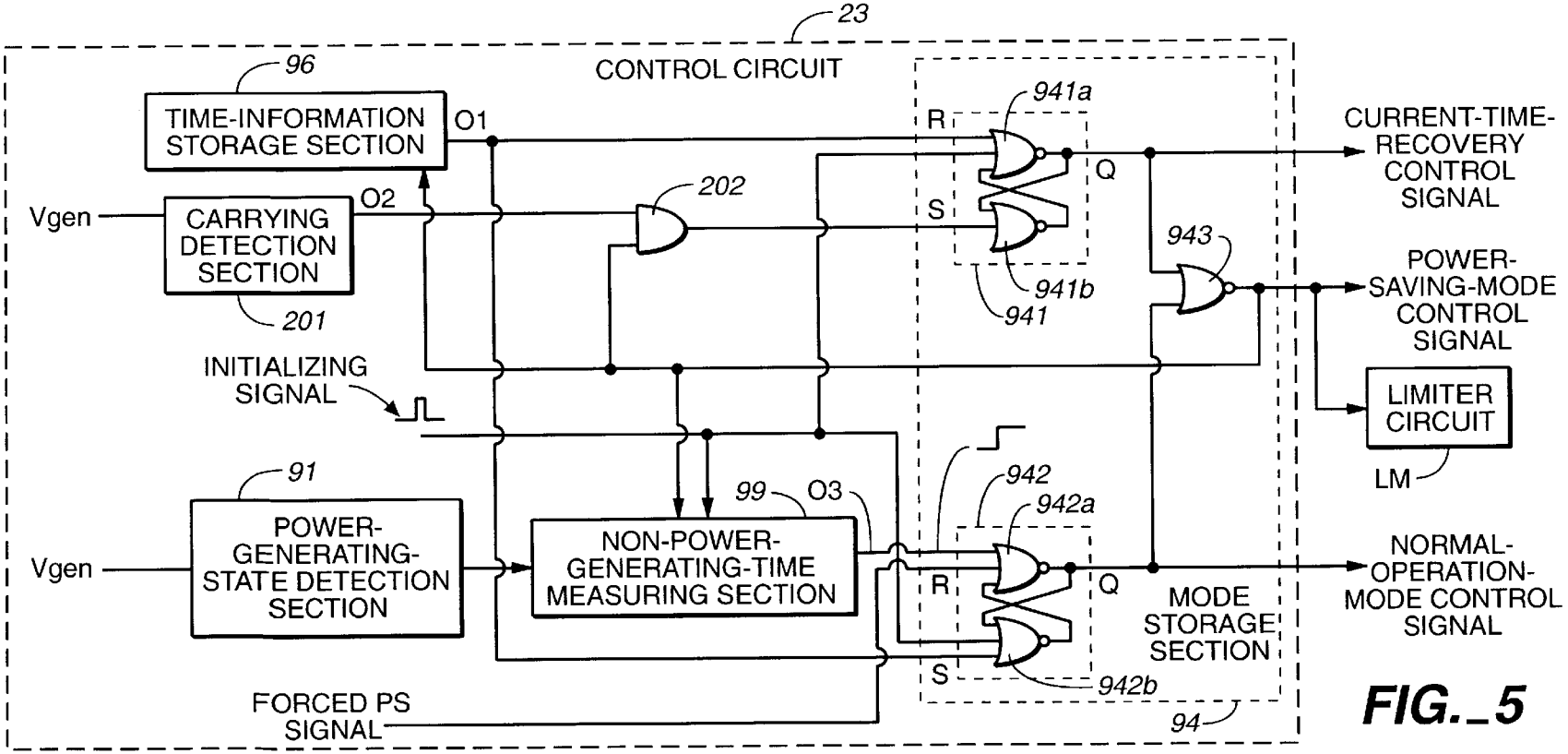
FIG. 5 is a block diagram showing details of a peripheral circuit of a mode storage section 94 in a time-measurement apparatus 1 shown in FIG. 2.

A detailed example structure of a peripheral circuit of the mode storage section 94 shown in FIG. 2 will be described below by referring to FIG. 5. In FIG. 5, the same symbols as those in FIG. 2 are assigned to the components corresponding to those shown in FIG. 2.

The mode storage section 94 shown in FIG. 5 is formed of two SR flip-flop circuits 941 and 942, and a two-input NOR circuit 943 receiving the outputs of the SR flip-flop circuits 941 and 942 as input signals.

The SR flip-flop circuit 941 is formed of two cross-connected NOR circuits 941*a* and 941*b*. When the NOR circuit 941*a* outputs a positive-logic signal Q, the input signal of the NOR circuit 941*a* corresponds to a reset signal R and the input signal of the NOR circuit 941*b* corresponds to a set signal S.

The SR flip-flop circuit 942 is formed of two cross-connected NOR circuits 942*a* and 942*b*. When the NOR circuit 942*a* outputs a positive-logic signal Q, the input signal of the NOR circuit 942*a* corresponds to a reset signal R and the input signal of the NOR circuit 942*b* corresponds to a set signal S.

The output Q of the SR flip-flop circuit 941 serves as a current-time-recovery control signal (an "H" level indicates a current-time-recovery mode), the output Q of the SR flip-flop circuit 942 serves as a normal-operation-mode control signal (an "H" level indicates the normal operation mode), and the output of the NOR circuit 943 serves as a power-saving-mode control signal (an "H" level indicates the power-saving mode). The power-saving-mode control signal output from the NOR circuit 943 is input to the limiter circuit LM. When the power-saving-mode control signal has an "H" level, the limiter circuit LM is turned off (a short-circuit node is opened).

The time-information storage section 96 measures the power-saving-mode lasting time as the count of the up/down counter, and reduces the count when the power-saving mode is switched to the normal operation mode, as described by referring to FIG. 2. The time-information storage section 96 receives the power-saving-mode control signal output from the NOR circuit 943. The time-information storage section 96 shown in FIG. 5 outputs an output signal O1 which has an "L" level when the counter holds the count (time information). This signal O1 is input to the SR flip-flop circuit 941 as a reset signal R and also input to the SR flip-flop circuit 942 as a set signal S.

A carrying detection section 201 receives the electromotive force Vgen of the power generating section A as an input signal, and sets an output signal O2 to an "H" level when a matching condition is satisfied according to the electromotive force Vgen and its change-in-time state, which indicates that the time-measurement apparatus 1 is being carried. The power-generating-state detection section 91 can be used as the carrying detection section 201. Alternatively, the carrying detection section 201 can be configured such that it is separated from the power-generating-state detection section 91 and uses a carrying detection sensor which can detect a carrying state, such as an acceleration sensor or a contact sensor.

The output signal O2 of the carrying detection section 201 is input to one input terminal of a two-input AND circuit 202. The power-saving-mode control signal output from the NOR circuit 943 is input to the other input terminal of the AND circuit 202. The output signal of the AND circuit 202 is input to the RS flip-flop circuit 941 as the set signal S. The non-power-generating-time measuring circuit 99 outputs an output signal O3 which has an "H" level when the non-power-generating time Tn is equal to or more than the predetermined specified time period according to the detection result of the power-generating state detected by the power-generating-state detection section 91, as described by referring to FIG. 2. In the structure shown in FIG. 5, the power-saving-mode control signal and an initializing signal are also input to the non-power-generating-time measuring circuit 99, and the time measurement value is initialized in the power-saving mode and at initialization. This initializing signal is a signal used for initializing each circuit of the inside. It has a predetermined time width and is generated at a predetermined condition according to an external input or the state of the internal circuit. The initializing signal is also input to the RS flip-flop circuit 941 as a reset signal and to the RS flip-flop circuit 942 as a set signal, as well as to the non-power-generating-time measuring circuit 99. A forced PS (power saving) signal is generated when a specifying manipulation for forcibly switching to the power-saving mode is performed on the external input unit 100, and is input to the RS flip-flop circuit 942 as a reset signal R.

In the above structure:

(1) In the initial state, the initializing signal pulse having the predetermined time width is input and the mode storage section 94 is set to the normal operation mode (the RS flip-flop circuit 941 is in a reset state and the RS flip-flop circuit 942 is in a set state), the normal-operation-mode control signal is set to an "H" level, the current-time-recovery control signal is set to an "L" level, the power-saving-mode control signal is set to an "L" level, and the operation mode is set to the normal operation mode.

(2) When the non-power-generating state is maintained and the output O3 of the non-power-generating-time measuring circuit 99 has an "H" level, or when the forced PS signal (a forced signal for switching to the power-saving mode, output when switching to the power-saving mode is forcibly specified by manipulating the crown, or for some other reason) is input, the power-saving-mode control signal is set to an "H" level and the operation mode is switched to the power-saving mode (both RS flip-flop circuit 941 and RS flip-flop circuit 942 are in a reset state).

(3) In the power-saving mode, the time-information storage section 96 counts the elapsed time of the power-saving mode. The output signal O1 of the time-information storage section 96 becomes an "L" level (time information is being stored). The limiter circuit LM is turned off in the power-saving mode.

(4) When the carrying detection section 201 detects a carrying state in the power-saving mode, since the output signal O2 of the carrying detection section 201 becomes an "H" level, the current-time-recovery control signal is set to an "H" level (the RS flip-flop circuit 941 is in a set state and the RS flip-flop circuit 942 is in a reset state), and the current-time-recovery operation is started. The current-time-recovery operation is executed with the counter of the time-information storage section 96 being reduced. When the counter reaches zero, the output signal O1 of the time-information storage section 96 becomes an "H" level, and the operation mode is switched from the current-time-recovery mode to the normal operation mode (the RS flip-flop circuit 941 is in a reset state and the RS flip-flop circuit 942 is in a set state).

[Advantages]

According to the present invention, the power-generation voltage of power generating means (the power generating unit) is detected, and the operation mode of means to be driven is switched between the normal operation mode and the power-saving mode according to the power-generating state of the power-generating means or according to the manipulation state of manipulation means. When the operation mode of the unit to be driven is the power-saving mode, since the operation of the limiter is disabled, it is possible in the power-saving mode that the power-generating state of the power generating unit is detected and the operation mode is positively switched to the normal operation mode.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An electronic apparatus, which is portable, comprising:

power generating means for generating power by converting a first energy to an electrical energy;

power source means for accumulating the electrical energy generated by the power generating means;

means to be driven by electrical energy supplied from the power source means;

power-generation detection means for detecting whether the power generating means is generating power;

voltage detection means for detecting whether one of a power-generation voltage at the power generating means and an accumulated voltage at the power source means exceeds a predetermined reference voltage;

limiter means for limiting the voltage of the electrical energy supplied to the power source means to a predetermined reference voltage, according to a detection result of the voltage detection means;

operation-mode control means for switching the operation mode of the means to be driven between a normal operation mode and a power-saving operation mode, according to a detection result of the power-generation detection means; and limiter control means for disabling the limiter means when the means to be driven is switched to the power-saving mode.

2. An electronic apparatus according to claim 1, wherein the means to be driven is time-indication means for indicating time.

3. An electronic apparatus according to claim 2, wherein the operation-mode control means disables the time indication means when the means to be driven is switched to the power-saving mode; and restarts the time-indication means to indicate a current time when the power-saving mode is switched to the normal operation mode.

4. An electronic apparatus according to claim 3, wherein the time-indication means comprises:

an analog-time indicator and an indicator driving means for driving the analog time indicator; and wherein the operation-mode control means comprises means for disabling the indicator driving means when the means to be driven is switched to the power-saving mode.

5. An electronic apparatus according to claim 4, wherein the limiter control means comprises means for re-activating the limiter means when the operation mode of the means to be driven is switched from the power-saving mode to the normal operation mode.

6. An electronic apparatus according to claim 1, wherein the operation-mode control means switches the operation mode according to the detection result of the voltage detection means.

7. An electronic apparatus according to claim 1, further comprising user manipulation means capable of various manipulations, and wherein the operation-mode control means switches the operation mode according to the user manipulation of the user manipulation means.

8. A control method for a portable electronic apparatus including a power generating unit for generating power by converting a first energy to an electrical energy, a power source unit for accumulating the electrical energy obtained by the power generating unit, a unit to be driven by the electrical energy, and a limiter unit for limiting the voltage of the electrical energy, supplied from the power generating unit to the power source unit, to a predetermined reference voltage, the control method comprising:

a power-generation detection step for detecting whether the power generating unit is generating power;

a voltage detection step for detecting whether one of a power-generation voltage at the power generating unit and an accumulated voltage at the power source unit exceeds the predetermined reference voltage;

an operation-mode control step for switching an operation mode of the unit to be driven between a normal operation mode and a power-saving mode, according to whether the power generating unit is generating power; and a limiter control step for disabling the limiter unit when the operation mode of the unit to be driven is switched to the power-saving mode.

9. A control method for the portable electronic apparatus according to claim 8, wherein the unit to be driven is a time-indication unit including an analog time indicator and an indicator driving unit for driving the analog time indicator; and wherein the operation-mode control step comprises disabling the indicator driving unit when the unit to be driven is switched to the power-saving mode.

10. A control method for the portable electronic apparatus according to claim 9, wherein the limiter control step further comprises re-activating the limiter unit when the operation mode of the unit to be driven is switched from the power-saving mode to the normal operation mode.

11. An electronic apparatus, which is portable, comprising:

a power generator for generating power by converting a first energy to an electrical energy;

a power source for accumulating the electrical energy generated by the power generator;

means to be driven by electrical energy supplied from the power source;

a power-generation detector for detecting whether the power generator is generating power;

a voltage detector for detecting whether one of a power-generation voltage at the power generator and an accumulated voltage at the power source exceeds a predetermined reference voltage;

a voltage limiter for limiting the voltage of the electrical energy supplied to the power source to a predetermined reference voltage, according to a detection result of the voltage detector;

an operation-mode controller for switching the operation mode of the means to be driven between a normal operation mode and a power-saving operation mode, according to a detection result of the power-generation detector; and a voltage limiter controller for disabling the voltage limiter when the means to be driven is switched to the power-saving mode.

12. An electronic apparatus according to claim 11, wherein the means to be driven is a time-indicator for indicating time.

13. An electronic apparatus according to claim 12, wherein the operation-mode controller disables the time indicator when the means to be driven is switched to the power-saving mode; and restarts the time-indicator to indicate a current time when the power-saving mode is switched to the normal operation mode.

14. An electronic apparatus according to 13, wherein the time-indicator comprises:

an analog-time indicator and an indicator driver for driving the analog time indicator; and wherein the operation-mode controller comprises a circuit for disabling the indicator driver when the means to be driven is switched to the power-saving mode.

15. An electronic apparatus according to claim 14, wherein the voltage limiter controller comprises a circuit for re-activating the voltage limiter when the operation mode of the means to be driven is switched from the power-saving mode to the normal operation mode.

16. An electronic apparatus according to claim 11, wherein the operation-mode controller switches the operation mode according to the detection result of the voltage detector.

17. An electronic apparatus according to claim 11, further comprising a user input unit capable of various manipulations, and wherein the operation-mode controller switches the operation mode according to the user manipulation of the user input unit.

* * * * *